United States Patent [19]

Schurch

[11] Patent Number: 4,715,508

[45] Date of Patent: Dec. 29, 1987

[54] COLLAPSIBLE CONTAINER

[75] Inventor: Richard C. Schurch, Livonia, Mich.

[73] Assignee: BMC Manufacturing Inc., Plymouth, Mich.

[21] Appl. No.: 895,260

[22] Filed: Aug. 11, 1986

[51] Int. Cl.[4] ..... B65D 7/24

[52] U.S. Cl. ..... 220/7; 220/1.5; 220/6

[58] Field of Search ..... 220/7, 6, 19, 1.5

[56] References Cited

U.S. PATENT DOCUMENTS

| | | | |
|---|---|---|---|
| 2,579,655 | 12/1951 | Donald | 220/6 |
| 3,981,410 | 9/1976 | Schurch | 220/6 |
| 4,150,762 | 4/1979 | Brunette | 220/19 |
| 4,186,841 | 2/1980 | Buckley et al. | 220/7 X |

OTHER PUBLICATIONS

"Here's the New Bathey KdR Knock Down Rigid Welded Wire Mesh Container", LBMC-376 10 M OH.P. 2-77 (4 sides).

*Primary Examiner*—Steven M. Pollard
*Attorney, Agent, or Firm*—Cullen, Sloman, Cantor, Grauer, Scott & Rutherford

[57] ABSTRACT

A rigid collapsible container has a base with upstanding interconnected lower corner posts mounting a deck. A pair of end assemblies with upper corner posts overlie the lower corner posts, have a normal upright position and are pivotal to a horizontal position. Each upper corner post has a depending connector which extends into a lower corner post and is pivotally mounted thereon. Each lower corner post has an upwardly opening slot terminating in a cam detent notch. A transverse lock pin on each connector is supportably nested within a slot to maintain the end assemblies upright. The end assemblies may be successively pivoted inwardly to a collapsed position with the lock pins riding against the cam notches. Spaced front and rear panels are arranged between the end assemblies and pivoted upon the base and include retractable latches which interlock with the upper corner posts. The front and rear panels are successively collapsible upon the deck and the end assemblies are successively collapsible thereover. Anchor pins depend from the upper ends of the front and rear panels and are nested with upwardly opening slotted anchor brackets when in an upright position for interlocking opposite ends of the panels with the end assemblies.

13 Claims, 9 Drawing Figures

COLLAPSIBLE CONTAINER

FIELD OF THE INVENTION

The invention relates to rigid collapsible containers for use in industry to store and transport parts of various sizes.

BACKGROUND OF THE INVENTION

Heretofore rigid stackable and collapsible containers have been employed in industry for the manufacture, storage and transport of parts of any size. The containers are for single purpose use and are not designed to handle every part and to serve every purpose. The particular containers may be stacked for convenient storage and may be transported by a lift truck or other vehicle from place to place. The containers of generally rectangular configuration, may have side or end assemblies or panels constructed, as an example, from plastic, corrugated sheet metal, metal wire or flat metal sheet to retain small parts or combinations thereof. Other containers may have assemblies or panels which are open but have structural elements, sufficient to retain larger products such as gasoline tanks. Various combinations of side and end assemblies and panels may be employed in a single container designed for a particular part or product.

THE PRIOR ART

The closest prior art patent is my U.S. Pat. No. 3,981,410 entitled "Rigid, Collapsible and Nestable Container" which issued on Sept. 21, 1976.

SUMMARY OF THE INVENTION

An important feature of the present invention is to provide an improved rigid collapsible container which comprises a rectangular base having lower corner posts which are rigidly interconnected and upon which are mounted a pair of upright spaced end assemblies which overlie the corner posts. The end assemblies have a normal upright position and are pivotal to a horizontal collapsed position to overlie a deck secured upon the rectangular base.

Another feature is to provide an improved end assembly construction by which the respective ends include a pair of upper corner posts which overlie the corresponding lower corner posts of the collapsible container and terminate in post connectors which depend from the upper corner posts, extend into the lower corner posts of the base and are pivotally mounted thereon and have a normal upright position.

Still another feature is to provide a suitable interlock assembly between the end assemblies and the upper corner posts such that the end assemblies will maintain an upright position relative to the base whether or not intermediate front and rear panels are employed. The end assemblies have the further characteristic of being pivotal to a horizontal position so as to overlie and be supported upon the deck when not in use or for storage or for stacking.

A further feature includes an improvement in the construction of the lower corner posts to define within the top thereof upwardly opening slots which terminate in inclined detent cam notches adapted to receive transverse lock pins upon the post connectors supportably retaining the end assemblies within the lower corner posts wherein the end assemblies may be successively pivoted inwardly to a collapsed position with the respective pins riding against the cam notches for automatically disengaging the pins from the slots without the necessity of manually disengaging the pins from the slots and without the necessity of manually lifting the end assemblies to disengage them from the corresponding underlying supporting corner posts.

A still further feature to provide an improved collapsible container which includes front and rear panels which are interposed between the end assemblies and at their lower ends are pivotally mounted upon the base and normally assume an upright position with suitable latching means between upper portions of the front and rear panels interconnected with the end assemblies for maintaining the front and rear panels in an upright position.

Another feature is to provide between the panels and end assemblies a mechanical interlock between upper portions of the front and rear panels and the corresponding upper corner posts of the end assemblies.

A further feature is the construction of the front and rear panels and the end assemblies, where the panels and assemblies may be constructed from a flat sheet or corrugated sheet, either metal or plastic, or may be made from right angularly related welded wire mesh for visual access to the interior and some of the panels and assemblies may be solid or corrugated and others may be wire mesh or alternatively all of the panels and/or assemblies may be of a welded wire mesh construction.

A still further feature is to provide an improved latch mechanism for the respective front and rear panels or assemblies adjacent their upper ends adapted for mechanical interlock with the adjacent upper corner posts of the end assemblies such as will maintain the front and rear panels in an upright position as desired. In such a construction the latching means may be retracted to permit the successive pivotal collapsing movement of the front and rear panels to overlie the base of the container and to permit successive additional pivotal collapsing movement of the end assemblies over the front and rear panels.

An optional feature of the invention is to provide, within at least one if not both of the front and rear panels, top and bottom sections for one or both of the panels and wherein the bottom section is pivotally mounted along its lower edge upon the base of the container and the top section is pivotally mounted upon its lower edge to the top of the bottom section. In such a construction for each of the respective top and bottom panels there are provided retractable latches adapted to interlock with corresponding latch brackets in the corresponding upper corner posts of the end assemblies and the latches of the top section may be retracted to permit pivotal opening movement of the top section relative to the bottom section to provide access to the interior of the container.

These and other features will be seen from the following specification and claims in conjunction with the appended drawings.

THE DRAWINGS

It will be understood that the above drawings illustrate merely a preferred embodiment of the invention, and that other embodiments are contemplated within the scope of the claims hereafter set forth.

DETAILED DESCRIPTION OF THE EMBODIMENT OF THE INVENTION

Figure 1:
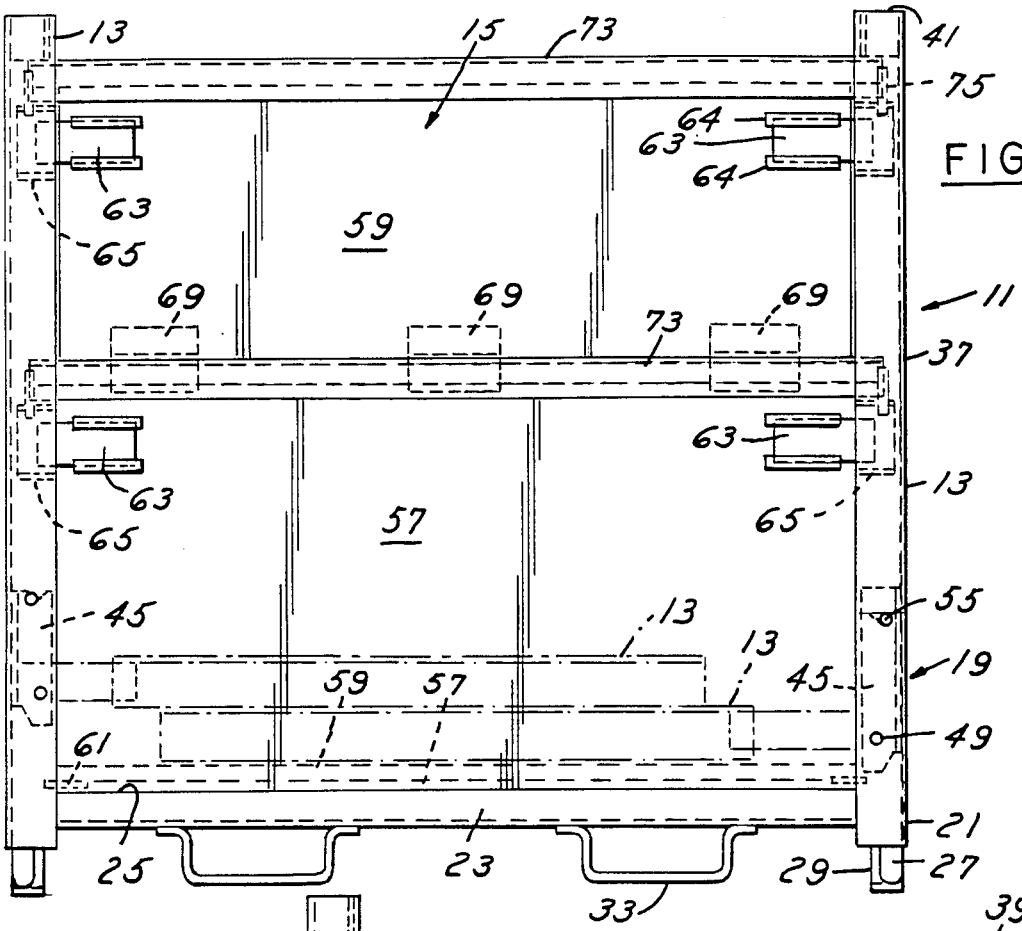
FIG. 1 is a front elevational view of the container illustrating one type of construction for a front panel. The container, when collapsed, is shown in dotted lines.

Referring now to the drawings and FIGS. 1–7 inclusive, the present rigid nestable collapsible container 11, FIG. 1, includes a pair of laterally spaced upright end assemblies 13, a front panel 15, a rear panel 17, mounted upon rectangular base 19. The assemblies and panels may be constructed, as an example, from corrugated sheets, as in FIG. 5, or from welded wire mesh, as in FIG. 4 or from flat sheets made from metal or plastic or combinations thereof.

The base 19 of the rigid collapsible container is preferably of rectangular shape and includes a plurality of upright corner posts sometimes referred to as lower corner posts 21, of right angular shape, with pairs of the lower corner posts interconnected by corresponding tubes or channels 23 to provide a rigid welded construction.

Overlying the channels 23 of the base 19 and suitably secured thereto is a horizontal deck 25 which is preferably apertured but may under some circumstances be solid or of welded wire mesh construction as shown in my earlier U.S. Pat. No. 3,981,410 depending on the nature of the goods or size of the parts or products to be stored or transported within the collapsible container.

Figure 2:
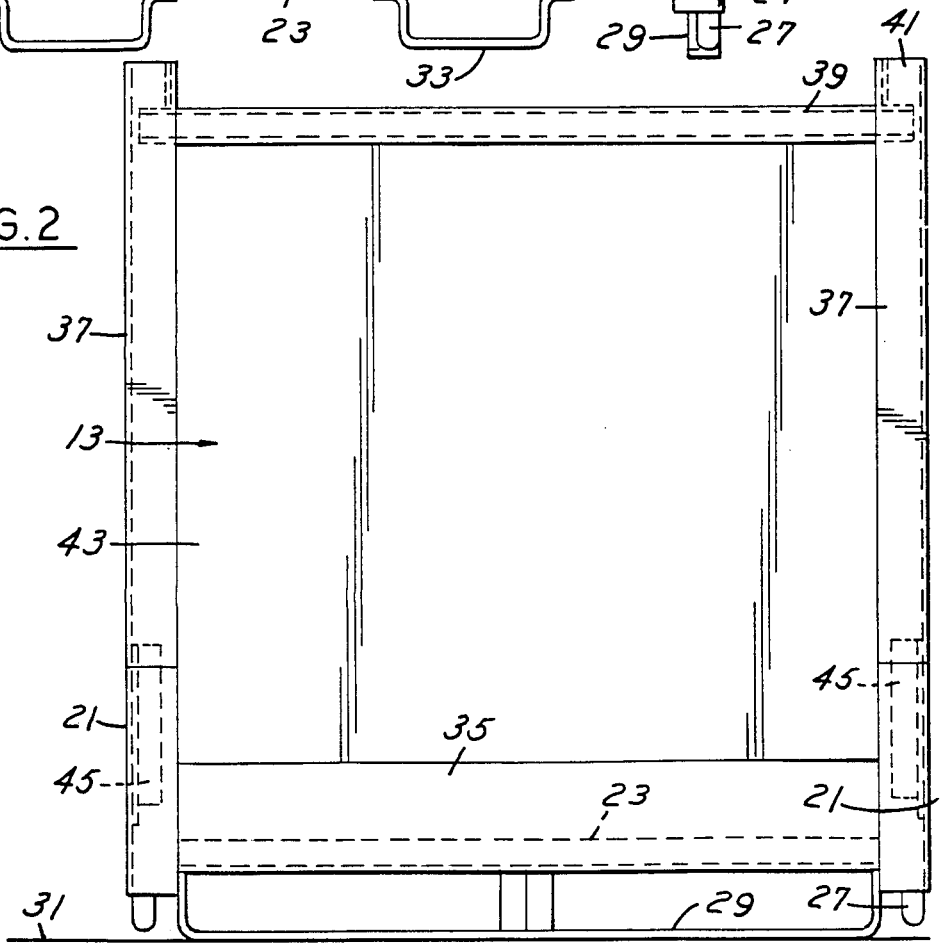
FIG. 2 is a right end view thereof illustrating one type of construction for an end assembly used in the container.

Depending from the base 19 and from the respective lower corner posts 21 are a plurality of male nesting plugs 27 or feet, FIGS. 1 and 2. The male plugs 27 are matable with the corresponding female nesting means or stacking pockets 41 at the upper ends of the upper corner posts 37. Underlying the corresponding channels 23 of the end assemblies 13 and extending between the respective plugs 27 are the elongated runners 29. The runners 29 depend from the deck 25 and are engageable with support surface 31 of FIG. 2. The runners 29 provide a load bearing surface which makes contact with surface 31 upon which the container 11 is placed. The feet or plugs 27 are spaced from surface 31 and are not designed to take any load.

As an optional feature a pair of laterally spaced fork lift brackets 33 may depend from corresponding channels or tubes 23 which form a part of the front and rear panels 15 and 17 as shown in FIG. 1.

The base of the present collapsible container 11, as shown in FIG. 2, includes as a part of each end assembly 13 the leg 35 of the channel 23. The leg 35 extends between the lower corner posts 21 and is suitably secured thereto as by welding to provide a rigid base construction.

Each of the end assemblies 13 includes a pair of laterally spaced upper corner posts 37, preferably of right angle shape which are interconnected at their top by the transverse channel or tube 39 suitably secured thereto. The ends of the tubes 39 project into upper end portions of the corresponding upper corner posts defining the female nesting pockets 41 which are adapted to supportably receive an overlying container 11. For this purpose the corresponding nesting plugs 27 of the respective end assemblies 13 cooperatively nest within the corresponding laterally spaced nesting pockets 41 at the upper ends of the upper corner posts 37 as mentioned previously. The use of the nesting pockets 41 is optional.

Figure 5:
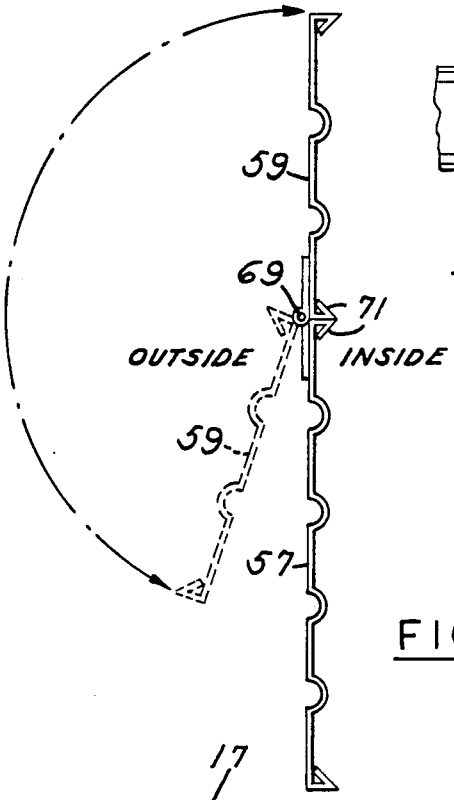
FIG. 5 is a schematic side elevational view of a corrugated panel, with the top section thereof being pivotal to the dash line position shown for access to the interior of the container.
Figure 4:
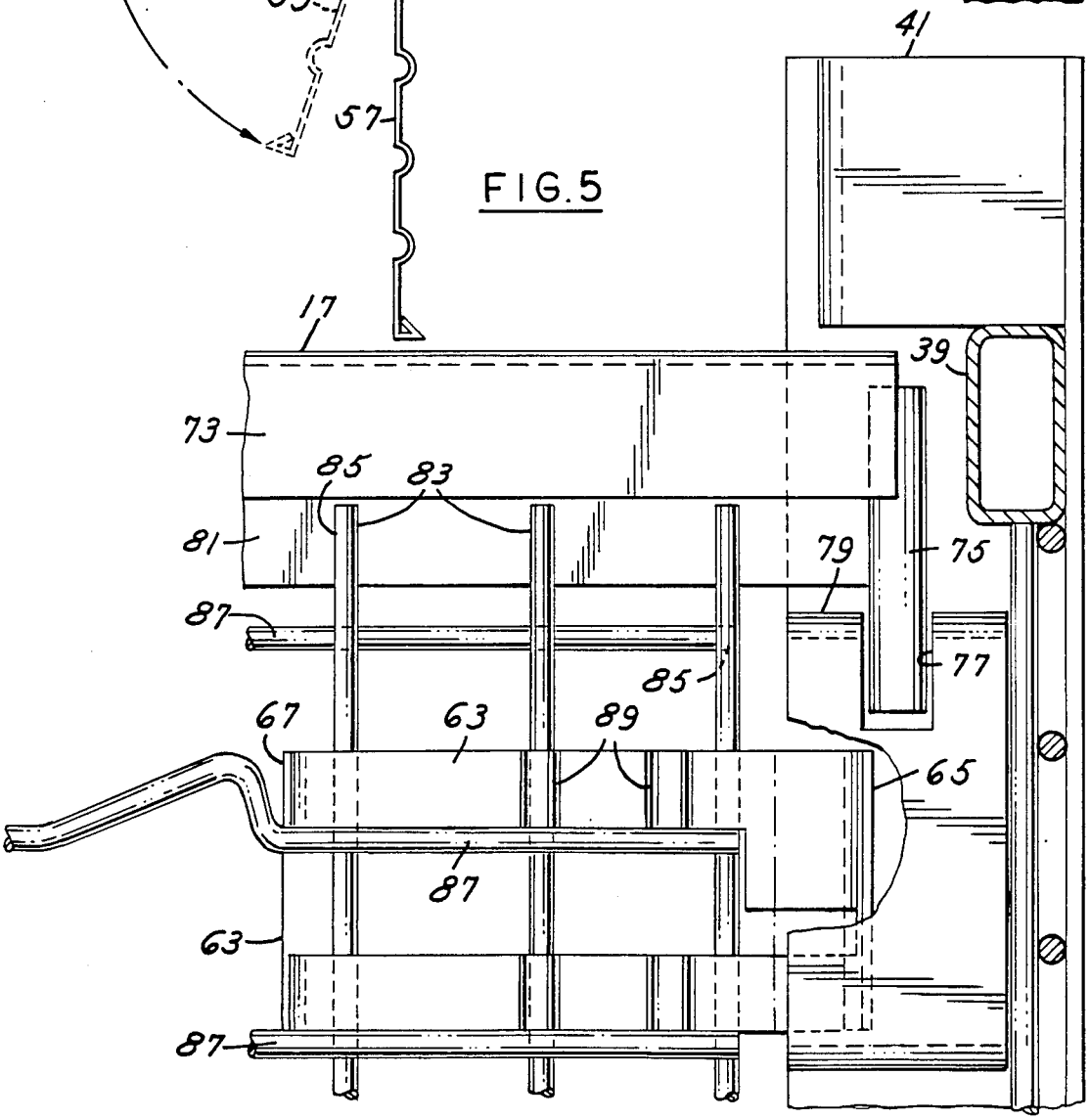
FIG. 4 is a fragmentary elevational view from the inside of the container viewing the rear panel shown in FIG. 3. The panel is constructed of welded wire mesh.

The respective end assemblies 13 as well as the front and rear panels 15 and 17 may be of sheet or corrugated construction, FIG. 5, or may be constructed of a plurality of right angularly related welded vertical and horizontal wires 83 and 87 suitably welded to each other and secured to portions of the leg 81 as by welding at 85, FIG. 4, for illustration. It is contemplated that the present container may have only a pair of end assemblies 13 and that these assemblies may be of a solid sheet as at 43, FIG. 2, or may be constructed of wire mesh such as shown fragmentarily in FIG. 4, or of a corrugated construction, FIG. 5. In addition, the end assembly may be of open construction, made from structural elements.

Depending from each of the respective upright upper corner posts 37 of the end assemblies 13 are corner post connectors 45 as shown in FIGS. 1, 2, 6 and 7. Each connector 45 has a pair of flanges arranged at a right angle.

Figure 7:
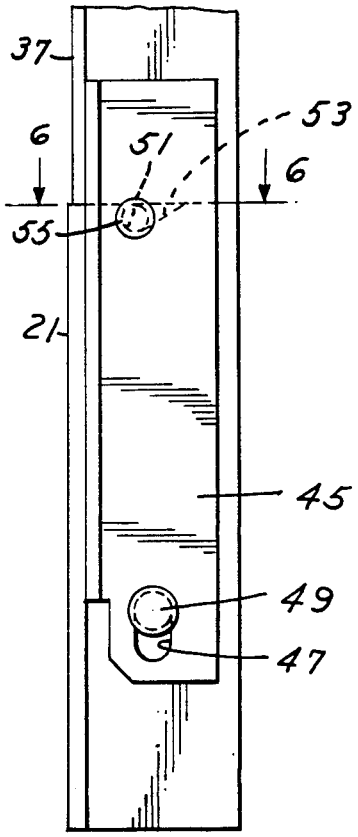
FIG. 7 is a fragmentary elevational view of the pivotal mounting of the upper corner post of an end assembly with its depending connector projected into and pivotally mounted upon the lower corner post shown on the left side of FIG. 1, and on an increased scale.

The connectors 45 adjacent their lower ends have upright elongated slots 47 which receive the transverse rivets 49. The rivets 49 are mounted upon the corresponding lower corner posts 21 as shown in FIGS. 1 and 7. This construction provides a pivotable mounting for the end assemblies 13 so as to overlie and be supported upon the corresponding lower corner posts 21 when the end assemblies are in the upright, solid line, position shown in FIGS. 1 and 2. Connection between the end assemblies 13 and the lower corner posts 21 further includes upwardly opening slots 51 formed within the upper ends of the respective lower corner posts 21. The slots 51 have sides which terminate in the upwardly and outwardly inclined cam detent notches 53, as shown in FIG. 7.

Figure 6:
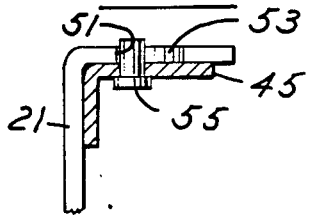
FIG. 6 is a fragmentary section taken in the direction of arrows 6—6 of FIG. 7.

Lock pin 55, FIGS. 6 and 7, is mounted upon an upper portion of the connector 45 and normally nests and is retained within the upright slot 51 for normally maintaining the corresponding assemblies 13 in an upright position against accidental tipping in the event that the front and rear panels are not in position or are not in use.

Connector lock pin 55 extends through connector 45 and into slot 51 of post 21. The construction is such that the nesting of the corresponding anchor pins or lock pins 55 upon the lower corner posts 21 normally maintain the end assemblies 13 in the upright position shown against any accidental disengagement which would not be possible unless the corresponding end assemblies were elevated from the position shown in FIGS. 1 and 7.

In my U.S. Pat. No. 3,981,410, referred to previously, it is necessary to manually lift the end assembly, which can be of considerable weight, in order to disengage the corresponding lock pins 51 from the adjacent slots 50 in the corner posts 12.

In the present construction any effort to mechanically rotate the end assembly 13 inwardly the corresponding lock pins 55 ride along the cam detent notches 53. This automatically elevates the lock pins 55 from slots 51 as the end assemblies are manually rotated to a horizontal collapsed position, FIG. 1. By this construction the respective end assemblies 13 are successively rotated to the dash line position shown in FIG. 1 so as to overlie the deck 25.

In the event there are employed front and rear panels 15 and 17 such as shown in FIG. 1, then the corresponding front and rear panels first collapse to the dash line position upon deck 25 (as shown at 57 and 59) corresponding to the lower and upper sections 57 and 59 of the front panel 15 in the illustrated embodiment.

Thus the respective pins 55 are nested within the slots 51 and retained therein to hold the end assemblies 13 in a safe upright position in the case either the front and rear panels are absent or if present have been already folded to the collapsed position shown in FIG. 1.

The pin detent arrangement shown at 55, 53 of FIG. 7 provides a means by which a person can tilt the remaining end assembly 13 to an inwardly folded position without having to lift the entire assembly by hand as was required in the prior art.

In referring to FIGS. 1 and 5 the front panel may include a bottom section 57 which is of a corrugated construction and a corrugated top or access section 57. As shown in FIG. 1, the bottom section 59 at its lower end at its opposite sides is pivotally mounted as at 61 to corresponding portions of the lower corner posts 21.

As one example, upper portions of the corresponding front and rear panels and particularly panels 57 and 59 are retained in an upright position by the retractable latch assemblies 63 slidably mounted as at 64 upon the corresponding panels, FIG. 1. Another example is shown in FIG. 4 where a modified latch plate 63 is advanced into the slot 65 of bracket 79 and interlocks therewith. The latch assemblies employed will depend upon the construction of the panels and end assemblies.

As an optional feature, the top section 59 of panel 15, FIG. 1, along its lower edge is hinged at 69 to the upper edge of bottom section 57 of the panel 15. This detail is further shown in FIG. 5 where each of the corresponding sections include a stop flange 71 which are in support engaging registry when the bottom and top panel sections are in alignment.

Upon retraction of the corresponding latch plates 63 the top section 59 may be folded outwardly and downwardly such as in the dash line position shown in FIG. 1 to engage the bottom section 57. This provides a means for obtaining access to the interior of the container for insertion or removal of parts or products and is particularly valuable when the containers are stacked. As shown in FIG. 1, the bottom section 57 towards its upper edge remote from its pivotal mounting 61 includes, as an example, a pair of opposed latch plates 63 similarly guidably mounted and when advanced project within corresponding apertured brackets 79 mounted upon adjacent portions of the upper corner posts 37. The latches maintain the bottom section 57 in the upright position shown. It should be understood that different latches may be used, such as shown in my patent mentioned previously or now used in the prior art.

While FIG. 1 illustrates the front panel 15 as composed of top and bottom sections 57 and 59, it is contemplated that the rear panel 17 could be of a similar construction or could be of a single panel. In addition both front and rear panels may each be of a single panel. In all events assuming that the rear panel is of unitary construction then in that case there would be required a pair of opposed top latches 63 for retaining the rear panel 17 in an upright position with respect to the adjacent upper corner posts 37 of the end assemblies.

Each of the corresponding front and rear panels includes top or hinge channel 73 welded as part thereof whose ends project into the open end portion of the opposed upper corner posts 37 of the respective end panels 13. Depending from opposite ends of the channel 73, as in FIG. 1, at the top of the respective panel sections 57 and 59 are the anchor pins 75, shown in detail and on a larger scale in FIG. 4. The pins 75 are in an upright position and are nested within the guide slots 77 in the apertured brackets 79. The brackets 79 are secured upon the interior of the corresponding upper corner posts 37 in such position that with the corresponding latch plates advanced for interlocking position there is provided a mechanical interlock between opposite ends of the front and rear panels and the corresponding end assemblies 13.

In FIG. 4 the corresponding rear panel 17 includes as part of the channel member 73 a leg 81 which is secured to the corresponding anchor pin 75. A series of laterally spaced vertical wires 83 depend from leg 81 and are suitably secured thereto as by welding at 85. A series of vertically spaced horizontal wires 87 span the corresponding vertical wires 83 and are suitably secured thereto by welding at 85 thereby forming an open wire mesh construction for rear panel 17.

The latch plate 63 of FIG. 5 is slidably mounted and retained with respect to the corresponding vertical wires 83 and corresponding horizontal wires 87 by any suitable guide such as the guide shown in FIG. 4.

Figure 3:
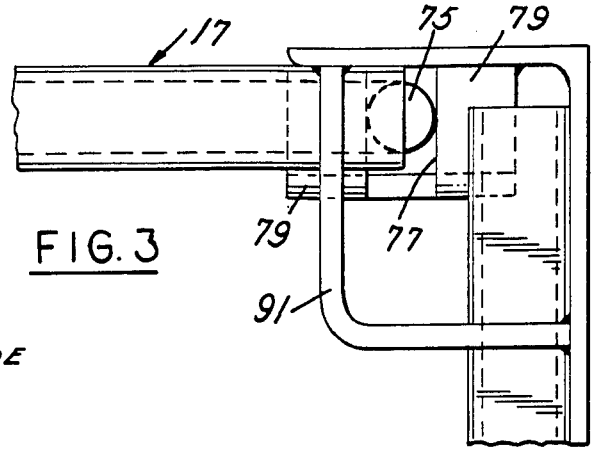
FIG. 3 is a fragmentary top plan view of the right rear corner of the container of FIG. 1.

With respect to the nesting pockets 41 shown in FIG. 1, an additional container 11 in fully opened position may be nested thereover for storage or transport. As shown in FIG. 3, corresponding to a fragmentary top view of FIG. 4, the pocket 41 is further defined by pocket flange 91 and suitably welded in position.

It is contemplated that the respective upper ends of the lower corner posts 21 are formed so that with the container fully collapsed, an additional collapsed container could be mounted thereover with its depending nesting plugs 27 projected within the upper ends of the lower corner posts 21. There may be a series of collapsed containers stacked in accordance with the present disclosure as shown in my earlier patent in FIGS. 9 and 10.

Figure 8:
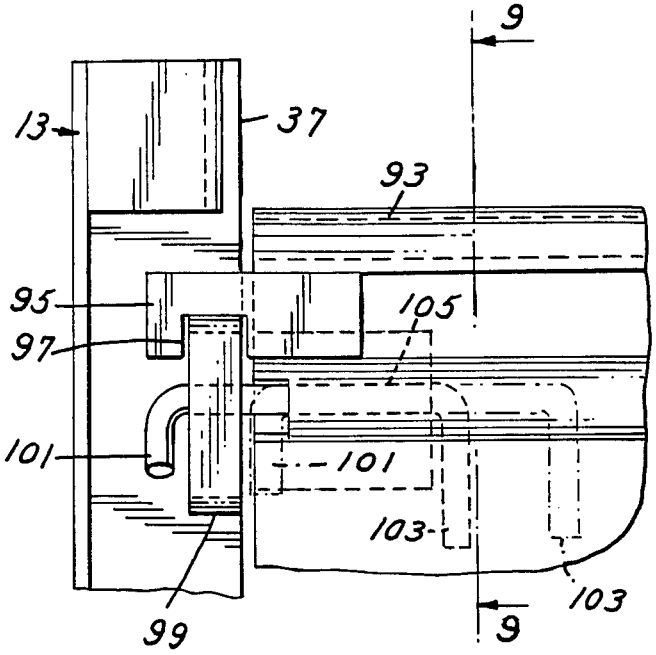
FIG. 8 is a fragmentary elevational view of a portion of a rear panel of the container illustrating a modified latch assembly and interlock between the rear panel and an adjacent end assembly.
Figure 9:
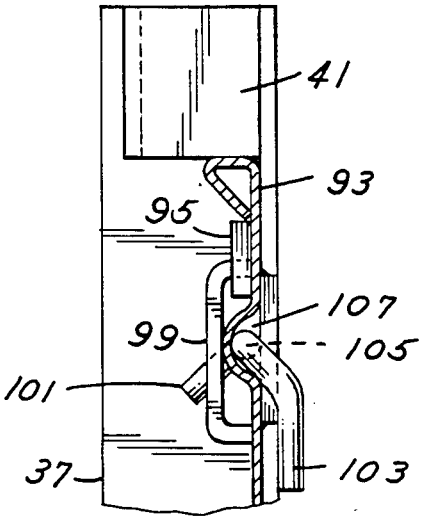
FIG. 9 is a fragmentary section taken in the direction of arrows 9—9 of FIG. 8.

A modification of the latching mechanism for the front and rear panels is fragmentarily shown in FIGS. 8 and 9 as particularly directed to the modified rear panel 93 which corresponds to rear panel 17 of FIG. 3. Projecting from opposite sides of rear panel 93 at its upper ends are a pair of laterally extending stop plates 95 with undercut rectangular slots 97 therein which extend beyond the corresponding rear panel 93 and into open portions of the corresponding upper corner posts 37, FIG. 8, one of which is shown.

Upright apertured bracket 99 is suitably secured as by welding to an interior wall of the upper corner posts 37, FIG. 8, so that when rear panel 93 is pivoted to the upright position shown the corresponding bracket 99 will cooperatively receive the apertured stop plate 95. This provides a mechanical interlock between the corresponding rear panel 93 and the adjacent opposed spaced end assemblies 13 one of which is shown in FIG. 8.

The latch assembly shown in FIGS. 8 and 9 represents a modification over the latch assemblies shown in FIG. 1 and 4 and in my earlier patent. The modified latch assembly includes a locking bar 105 having a depending handle 103 shown in dash lines FIG. 8, and at its opposite end has a depending lock pin 101, shown retracted. When rear panel 93 has been pivoted to the upright position shown handle 103 will advance shaft 105 and corresponding lock pin 101 in an upright position so as to pass through apertured bracket 99. Thereafter on limited rotation of handle 103 there will be an interlock of the lock pin 101 with respect to bracket 99, FIG. 9. This provides an alternate simplified means by which the respective front or rear panels or both may be interlocked with the corresponding portions of the adjacent end assemblies 13 as a modification.

As shown in FIG. 9 the locking bar 105 is rotatably supported and journaled upon an upper portion of the rear panel 93 adjacent its opposite sides as by the formed channel 107 as a part of the panel 93. Thus the locking rod 105 is adapted for pivotal movement with respect to channel 107 and can be advanced longitudinally therein so that lock pin 101 can project through the corresponding apertured bracket 99 and then be rotated to the interlock position, FIG. 9.

The containers, as shown in my earlier patent, are collapsed to conserve on storage and space and to provide a more economical return of containers that have been shipped. When the containers are returned in a collapsed condition, there is a 3 to 1 savings in space. Having described my invention, reference should now be had to the following claims.

I claim:

1. An improvement in a rigid collapsible container having a generally rectangularly-shaped base, the base including a plurality of lower corner posts, each lower corner post disposed at each corner of the base and each lower corner post disposed at each corner of the base and each lower corner post having a rivet securely fastened to and extending transversely from said each lower corner post, and the base including a plurality of horizontally-oriented cross members, each cross member rigidly joining a respective two lower corner posts on each side of the base, the container further having a deck secured upon the base, and the container having a pair of end assemblies, each end assembly including a pair of upper corner posts, each upper corner post associated with a respective lower corner post, each end assembly further including a pair of corner post connectors, each corner post connector having an upper portion rigidly connected to a respective upper corner post and a lower end depending from said respective upper corner post, said lower end pivotally affixed to a respective rivet so that each end assembly is swingable between an upstanding position and a position overlying the deck, said position overlying the deck being inwardly of the lower corner posts, the improvement comprising in combination:

each corner post connector having a lock pin extending transversely from the upper portion thereof and each lower corner post having an upper end including a detent notch into which the lock pin is receivable into a detent position, the detent notch having an edge cam surface inclined upwardly from the detent position and inwardly of the lower corner posts; and each corner post connector including a slot through which a respective rivet extends, the slot disposed in a lower portion of said each corner post connector and having an axis of elongation parallel to an axis along which each corner post connector extends, whereby, when an end assembly is swung from the upstanding position to the position overlying the deck, the lock pin is cammed out of the detent position as the lock pin is lifted by the edge cam surface, thus allowing collapsing of the end assembly without the necessity of manually disengaging the lock pin from the detent notch and without the necessity of manually lifting the end assembly, and, when an end assembly is swung from the position overlying the deck to the upstanding position, the lock pin reaches a position at which the lock pin is cammed into the detent position.

2. In the collapsible container of claim 1, the improvement further comprising:

spaced front and rear panels interposed between said end assemblies, the front and rear panels having lower ends pivotally mounted upon said base, and being erectable to an upright position and collapsible to a horizontal position overlying said deck; and latch means upon upper portions of said front and rear panels, each latch means interlocked with a respective upper corner post;

the front and rear panels when unlatched adapted for successive pivotal movement to the horizontal position from said deck, said end assemblies adapted for successive pivotal collapsing movement to overlie said front and rear panels.

3. In the improvement to the collapsible container of claim 2, at least one of said front and rear panels having a bottom section pivotally mounted upon said base; and a top section having a lower edge pivotally mounted upon said bottom section; and said latch means including opposed pairs of retractable latches upon said top and bottom sections spaced from the respective pivotal mountings of said top and bottom sections, said retractable latches, when advanced, interlocking with said upper corner posts and said retractable latches upon said top section, when retracted, permitting pivotal opening movement of said top section into engagement with said bottom section, allowing access to the interior of said container.

4. In the improvement to the collapsible container of claim 3, opposite sides of said top and bottom sections extend into said end assemblies;

anchor brackets mount upon corresponding upper corner posts, said anchor brackets being vertically spaced and having upwardly opening slots; and anchor pins depend from the opposite ends of said top and bottom sections and nest respectively within said brackets when said brackets and said top and bottom sections are in upright positions, the nesting of the anchor pins within said brackets interlocking opposite ends of said top and bottom sections with said end assemblies respectively.

5. In the improved collapsible container of claim 2, opposite sides of said front and rear panels extend into said end assemblies;

anchor brackets are secured upon each of said upper corner posts, said anchor brackets including slots which open upwardly when said upper corner posts are in an upright position; and anchor pins depend from the opposite upper ends of said front and rear panels and nest within said brackets when said brackets and said panels are in upright positions, the nesting of said anchor pins within said brackets interlocking opposite ends of said front and rear panels with respective end assemblies.

6. In the improved rigid collapsible container of claim 2, said latch means includes opposed pairs of retractable latch plates guidably mounted upon said front and rear panels; and corresponding apertured brackets are secured upon said upper corner posts and receive said latch plates when said latch plates are advanced so that said front and rear panels are maintained in an upright position.

7. In the improved rigid collapsible container of claim 6, opposite sides of said front and rear panels extend into said end assemblies;

anchor brackets are secured upon each of said upper corner posts, said anchor brackets including slots, each slot opening upwardly when the respective corner post on which the bracket is secured is in an upright position; and anchor pins depend from opposite ends of said front and rear panels and said anchor pins are nested within said brackets when said front and rear panels are in upright positions to interlock opposite sides of said front and rear panels with said end assemblies respectively.

8. In the improved rigid collapsible container of claim 2, said latch means includes opposed pairs of retractable latch bars rotatably mounted upon said front and rear panels each of said latch bars terminating in a latch pin; and a corresponding apertured bracket upon each said upper corner post receiving each latch bar and latch pin when said each latch bar and latch pin are advanced and a limited rotation of said latch bar interlocks said latch bar with said bracket.

9. In the improved rigid collapsible container of claim 8, a pair of laterally extending stop plates projecting from opposite sides of each of said front and rear panels and extending beyond said each of said front and rear panels into open portions of corresponding upper corner posts, said stop plates cooperatively receiving said latch brackets when said panels are in an upright position, thereby interlocking said each of said front and rear panels with said end assemblies.

10. In the improvement to the collapsible container of claim 1, the slot is disposed proximate to the lower end of each corner post connector.

11. An improvement in a rigid collapsible container having a generally rectangularly shaped base, the base including a plurality of lower corner posts, each lower corner post disposed at each corner of the base and each lower corner post having a rivet securely fastened to and extending transversely from said each lower corner post, and the base including a plurality of horizontally oriented cross members, each cross member rigidly joining a respective two lower corner posts on each side of the base, the container further having a deck secured upon the base, the container having a pair of end assemblies, each end assembly including a pair of upper corner posts, each upper corner post associated with a respective lower corner post, each end assembly further including a pair of corner post connectors, each corner post connector having an upper portion rigidly connected to a respective upper corner posts and a lower end depending from said respective upper corner post, said lower end pivotally affixed to a respective rivet so that each end assembly is swingable between an upstanding position and a position overlying the deck, said position overlying the deck being inwardly of the lower corner posts, and the container having spaced front and rear panels interposed between said end assemblies, the front and rear panels including lower ends pivotally mounted upon said base so that the front and rear panels are erectable to an upright position and collapsible to a horizontal position overlying said deck, the improvement comprising, in combination:

each corner post connector having a lock pin extending transversely from the upper portion thereof and each lower corner post having an upper end including a detent notch into which the lock pin is receivable into a detent position, the detent notch having an edge cam surface inclined upwardly from the detent position and inwardly of the lower corner posts, so that the lock pin is camable out of the detent position along the edge cam surface to allow collapsing of the end assembly without the necessity of manually disengaging the lock pin from the detent notch and without the necessity of manually lifting the end assembly;

anchor brackets secured upon each of said upper corner posts, said anchor brackets including slots which open upwardly when said upper corner posts are in an upright position; and anchor pins depending from the opposite upper ends of said front and rear panels and nested within said brackets when said brackets and said panels are in upright positions, the nesting of said anchor pins within said brackets interlocking opposite ends of said front and rear panels with said end assemblies.

12. A rigid collapsible container comprising:

a rectangular base having upstanding lower corner posts at each of its corners, each lower corner post having an upper end including a detent notch having an edge cam surface;

cross members interconnecting adjacent pairs of lower corner posts;

a deck secured upon said base;

a pair of spaced end assemblies respectively overlying adjacent pairs of lower corner posts, each end assembly having a normal upright position and being pivotal inwardly of said lower corner posts to a horizontal, collapsed position overlying said deck, each cam surface being inclined upwardly from a detent position and inwardly of said lower corner posts and each end assembly having a pair of upper corner posts aligned with and supported upon said lower corner posts;

a corner post connector depending from each upper corner post extending into a corresponding lower corner post and pivotally mounted thereon;

a lock pin extending transversely from the upper portion of each corner post connector, each lock pin being receivable into the detent position within a respective detent notch and each lock pin being liftable out of the detent position by the edge cam surface to allow collapsing of the end assembly without the necessity of manually disengaging the lock pin from the detent notch and without the necessity of manually lifting the end assembly;

spaced front and rear panels interposed between said end assemblies, each of said front and rear panels having opposite sides extending into end assemblies and lower ends pivotally mounted upon said base, said front and rear panels collapsible from a normal upright position to a horizontal position overlying said deck;

latch means upon upper portions of said front and rear panels interlockable with said upper corner posts respectively, said front and rear panels adaptable for successive pivotal movement to a collapsed position upon said deck with said end assemblies adapted for successive pivotal collapsing movement to overlie said front and rear panels;

anchor brackets upon each of said upper corner posts, each of said anchor brackets having a slot which opens upwardly when the corner post upon which said bracket is secured is in an upright position; and anchor pins depending from opposite ends of said front and rear panels, said anchor pins nestable within said brackets when said upper corner posts are in upright position, the nesting of said anchor pins with said brackets for interlocking opposite ends of said front and rear panels with said end assemblies respectively.

13. A rigid collapsible container comprising:

a rectangular base having upstanding lower corner posts at each of its corners, each lower corner post having an upper end including a detent notch having an edge cam surface;

cross members interconnecting adjacent pairs of lower corner posts;

a deck secured upon said base;

a pair of spaced end assemblies respectively overlying adjacent pairs of lower corner posts, each end assembly having a normal upright position and being pivotal inwardly of said lower corner posts to a horizontal, collapsed position overlying said deck, each cam surface being inclined upwardly from a detent position and inwardly of said lower corner posts and each end assembly having a pair of upper corner posts aligned with and supported upon said lower corner posts;

a corner post connector depending from each upper corner post extending into a corresponding lower corner post and pivotally mounted thereon;

a lock pin extending transversely from the upper portion of each corner post connector, each lock pin being receivable into the detent position within a respective detent notch and each lock pin being liftable out of the detent position by the edge cam surface to allow collapsing of the end assembly without the necessity of manually disengaging the lock pin from the extent notch and without the necessity of manually lifting the end assembly;

spaced front and rear panels interposed between said end assemblies, each of said front and rear panels having lower ends pivotally mounted upon said base, said front and rear panels collapsible from a normal upright position to a horizontal position overlying said deck, at least one of said front and rear panels including a bottom section pivotally mounted upon said base and a top section having a lower edge pivotally mounted upon said bottom section with opposite sides of said top and bottom sections extending into said end assemblies;

latch means upon upper portions of said front and rear panels interlockable with said upper corner posts respectively, said front and rear panels adaptable for successive pivotal movement to a collapsed position upon said deck with said end assemblies adapted for successive pivotal collapsing movement to overlie said front and rear panels, said latch means including opposed pairs of retractable latches upon said top and bottom sections, said latches spaced from respective pivotal mountings of said top and bottom sections and, when advanced, interlocking said top and bottom sections with said upper corner posts, the latches upon said top section, when retracted, permitting pivotal opening movement of said top section into contact with said bottom section so as to provide access to the interior of said container;

anchor brackets upon each of said upper corner posts, each of said anchor brackets having a slot which opens upwardly when the corner post upon which said bracket is secured is in an upright position; and anchor pins depending from opposite ends of said front and rear panels, said anchor pins nestable within said brackets when said upper corner posts are in upright position, the nesting of said anchor pins with said brackets for interlocking opposite ends of said front and rear panels with said end assemblies respectively.

* * * * *